US005806399A

United States Patent [19]

Öchsner

[11] Patent Number: 5,806,399

[45] Date of Patent: Sep. 15, 1998

[54] COUNTER-STRIP FOR A PERFORATING DEVICE

[75] Inventor: Rudolf Phillip Öchsner, Beindersheim, Germany

[73] Assignee: Koenig & Bauer-Albert Aktiengesellschaft, Wurzburg, Germany

[21] Appl. No.: 531,835

[22] Filed: Sep. 21, 1995

[30] Foreign Application Priority Data

Sep. 21, 1994 [DE] Germany ..... 44 33 602.0

[51] Int. Cl.[6] ..... B26D 7/00

[52] U.S. Cl. ..... 83/658; 83/99; 83/168; 83/169

[58] Field of Search ..... 83/658, 659, 98, 83/99, 100, 169, 168

[56] References Cited

U.S. PATENT DOCUMENTS

| | | | |
|---|---|---|---|
| Re. 17,892 | 12/1930 | Wood | 83/659 X |
| 707,294 | 8/1902 | Blackhall | 83/658 |
| 1,147,817 | 7/1915 | Samson et al. | 83/659 |
| 2,281,877 | 5/1942 | Green | 83/658 |
| 2,405,598 | 8/1946 | Miller | 83/659 |
| 2,523,153 | 9/1950 | Shapiro | 83/98 |
| 2,620,205 | 12/1952 | Vogt | 281/5 |
| 2,680,484 | 6/1954 | Stuck | 83/659 X |
| 2,775,448 | 12/1956 | Baker et al. | 281/5 X |
| 3,680,419 | 8/1972 | Stoop | 83/98 |
| 3,945,280 | 3/1976 | Roncato | 83/98 |
| 4,191,077 | 3/1980 | Edwards et al. | 83/99 |
| 4,574,669 | 3/1986 | Vercillo et al. | 83/399 |
| 4,653,363 | 3/1987 | Lang | 83/347 X |
| 4,951,967 | 8/1990 | Michalik | 83/660 X |
| 5,259,283 | 11/1993 | Michalik | 83/659 X |
| 5,357,831 | 10/1994 | Michalik | 83/659 X |

FOREIGN PATENT DOCUMENTS

| | | |
|---|---|---|
| 0 307 891 | 1/1993 | European Pat. Off. . |
| 50-122388 | 10/1975 | Japan . |
| 134290 | 6/1972 | Netherlands . |
| 1423377 | 2/1987 | U.S.S.R. . |

*Primary Examiner*—Maurina T. Rachuba
*Attorney, Agent, or Firm*—Jones, Tullar & Cooper, P.C.

[57] ABSTRACT

A counter-strip for a perforating device in a signature perforating assembly for a printing press is made of a resilient material and has a linearly extending bore. A support is placed in the bore and has a number of openings which will not interfere with the operation of perforating blades that are used to perforate signatures. The counter-strip is positioned in a counter-perforating cylinder and is supplied with compressed air that is used to remove paper dust from the bore.

11 Claims, 3 Drawing Sheets

COUNTER-STRIP FOR A PERFORATING DEVICE

FIELD OF THE INVENTION

The present invention is directed generally to a counter-strip for a perforating device. More particularly, the present invention is directed to a counter-strip for a counter-perforating cylinder in a printing press. Most specifically, the present invention is directed to a counter-strip for a counter-perforating cylinder in a perforating device for accomplishing the transverse perforation of signatures along an intended signature fold line. The counter-strip is positioned in the counter-perforating cylinder and is provided with a bore which extends along the length of the counter-strip. Paper dust, which is generated by signature perforating blades engaging the signatures to be perforated, is carried by the perforating blades into the bore in the counter-strip. A flow of air under pressure can then be used to remove this paper dust from the interior of the counter-strip.

DESCRIPTION OF THE PRIOR ART

In the field of rotary, web-fed printing, the printed web is led through a former and a folder where the web is cut into a plurality of web segments which are then transversely folded to form signatures. It is frequently the case that these signatures may have a large number of pages and are thus typically difficult to fold. It has become a well-known expedient to form a plurality of perforations or slits in the assembled plurality of web segments along what will be the transverse fold line. The formation of such a line of slits or perforations will facilitate the folding of the signatures in a more accurate and repeatable manner.

The signatures to be folded are perforated by directing the signatures through a perforating device which utilizes a perforating cylinder provided with a perforating blade, and a counter-perforating cylinder provided with a counter-strip. The teeth of the perforating blade pass through the signatures to be perforated and enter into the counter-strip, which is made of some type of resilient material. One such device for accomplishing transverse perforation of signatures, prior to the folding of the signatures is shown in European Patent Publication EP 0 307 891 B1. In this prior art device, a perforating blade strip of a perforating cylinder acts against a counter-strip of a counter-perforating cylinder.

One problem that is typically encountered in signature perforating devices is the accumulation of paper dust or paper particles that are generated. As the signature perforating blade's teeth enter into, and pass through the sheets of paper that form the signature being perforated, they generate a large amount of paper dust or paper particles. This dust or particles will be carried along by the signatures and may collect on various surfaces of the printing press. They may become mixed with lubricants used on the press and may cause various problems. The continuous production of this paper dust by the signature perforating device is an ongoing problem.

It will thus be seen that a need exists for a signature perforating device that overcomes the limitations of the prior art. The counter-strip for a perforating device in accordance with the present invention provides such a device and is a significant improvement over the prior art.

SUMMARY OF THE INVENTION

It is an object of the present invention to provide a counter-strip for a perforating device.

Another object of the present invention is to provide a counter-strip for a counter-perforating cylinder in a printing press.

A further object of the present invention is to provide a counter-strip in a counter-perforating cylinder of a signature transverse perforating device.

Still another object of the present invention is to provide a counter-strip having an internal bore.

Yet a further object of the present invention is to provide a resilient counter-strip which will prevent the harmful collection of paper dust generated during signature perforation.

Even still another object of the present invention is to provide a counter-strip having an internal reinforcement for its interior bore.

As will be discussed in detail in the description of the preferred embodiments which are presented subsequently, the counter-strip, for use in a signature transverse perforating assembly, is carried by a counter-perforating cylinder which cooperates with a perforating cylinder. A perforating blade strip is carried by the perforating cylinder and cooperates with the counter-strip to perforate the signatures. The counter-strip is made of a resilient material that can be penetrated by the teeth of the perforating blade. An internal bore extends along the length of the counter-strip and may be stiffened or reinforced by a coil spring, spaced rings or the like to prevent the perforating blades from collapsing the tube. As the perforating blade teeth pass through the signature and enter into the counter-strip, they carry paper particles into the interior bore of the counter-strip. A suitable supply of compressed air is used to remove the paper particles from this interior bore in the counter-strip. The paper dust or particles will thus not be allowed to escape and to cause any damage to the press assembly.

The counter-strip for a perforating cylinder in accordance with the present invention is very effective in reducing the danger of individual perforating teeth breaking off the perforating blade elements. The paper dust which is created by the signature perforating operations will enter into the notches in the counter-strip and then into the bore in the interior of the counter-strip where it is either blown or aspirated away. This assures that the action of the perforating blade strip will not be hampered or compromised by an accumulation of paper dust. The teeth will contact the counter-strip without interference and will thus be much less likely to break off from the perforating blade elements.

The placement of a support, such as a helical coil spring, within the bore in the counter-strip provides necessary support for the counter-strip while not diminishing its usefulness. The utilization of the support or reinforcement in the axial bore results in a long service life of the counter-strip. The coils of the spring can shift so that they do not interfere with the engagement of the individual perforating teeth with the notches in the counter-strip. The counter-strip in accordance with the present invention could also be used in connection with paper cutting devices.

The counter-strip for a perforating device in accordance with the present invention overcomes the limitations of the prior art. It is a substantial advance in the art.

BRIEF DESCRIPTION OF THE DRAWINGS

While the novel features of the counter-strip for a perforating device in accordance with the present invention are set forth with particularity in the appended claims, a full and complete understanding of the invention may be had by referring to the detailed description of the preferred embodiments which is presented subsequently, and as illustrated in the accompanying drawings, in which:

DETAILED DESCRIPTION OF THE PREFERRED EMBODIMENTS

Figure 1:
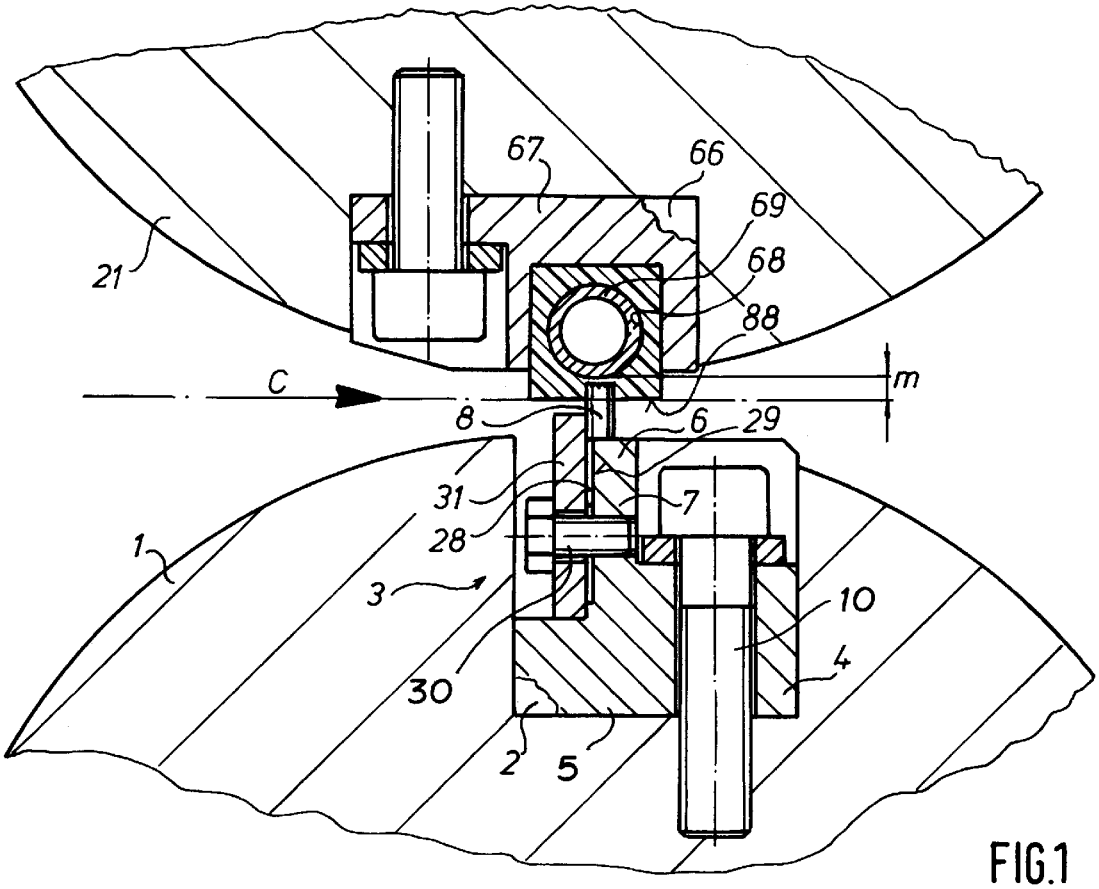
FIG. 1 is a cross-sectional end view of a perforating blade strip and a first preferred embodiment of a counter-strip in accordance with the present invention with the counter-strip disposed in a counter-perforating cylinder.
Figure 2:
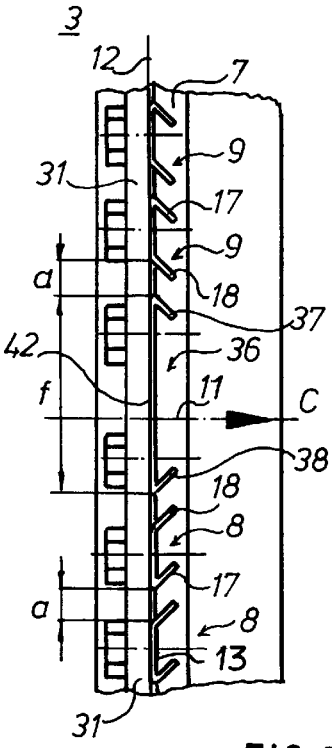
FIG. 2 is a top plan view of a portion of the perforating blade strip of FIG. 1 and showing portions of the strip on both sides of a plane that linearly bisects the perforating cylinder.

Referring initially to FIG. 1, there may be seen a folding unit of a rotary printing press which includes a perforating cylinder 1. The perforating cylinder 1 has a perforating blade strip, identified generally at 3, which is positioned in a trough 2 that extends across the cylinder 1. The perforating blade strip 3 is held in the trough 2 in a profiled blade holding strip 4 that is in the approximate shape of an inverted letter T and whose cross bar 5 is interlockingly connected with the bottom of the trough 2 by screws 10. The blade holding strip 4 is positioned in trough 2 extending in the axial direction of cylinder 1. A plurality of individual perforating blade elements, which are each identified by 8 or 9, as seen in FIGS. 1 and 2, are disposed to the right or left of a plane 11, which linearly bisects the perforating cylinder. The plane 11, which linearly bisects the perforating cylinder 1, intersects an axis of rotation of the perforating cylinder 1 at right angles. These perforating blade elements are supported by an end 6, and in particular on a front face of the end 6, of a leg 7 of blade holding strip 4 extending vertically, i.e. in the radial direction of the perforating cylinder 1.

Figure 3:
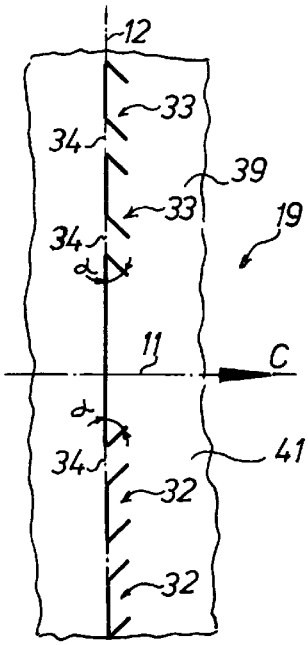
FIG. 3 is a top plan view of a portion of a signature perforated along a transverse fold line by the perforating blade strip of FIG. 2.

Each individual perforating blade element 8 or 9 has a straight perforating segment 13, as seen in FIG. 2 (identified as straight segment hereinafter) extending congruently with a future transverse fold line 12 in a signature 19, as depicted in FIG. 3. An angled perforating segment 17 or 18 (identified as angled segment hereinafter) respectively extends at both ends of the straight segment 13 of each perforating blade element 8 or 9. Both angled segments 17 and 18 are angled at an angle $\alpha$, for example 45°, with respect to the straight segment 13, so that the free ends of the angled segments 17 and 18 respectively, point generally in the direction of the plane 11 which linearly bisects the perforating cylinder 1 and simultaneously in the transport direction of a signature 19 or in the direction of rotation C of the perforating cylinder 1. The angled segments 17 and 18, as well as the straight segment 13 of the individual perforating blade elements 8 or 9 have cutting edges respectively on their upper sides facing a counter-perforating cylinder 21. The cutting edges can each be honed on one side or can be a finely toothed cutting edge. Because of a lesser height of the angled segments 17 and 18 with respect to the height of the straight segment 13, the undersides of the angled segments 17 and 18, respectively can be supported on the end face 6 of the vertical T-leg 7, while the end or tongue 28 of the straight segment 13 of the perforating blade element 8 or 9 rests against a long side 29 of the vertical T-leg 7 of the profiled blade holding strip 4 and is clamped in place, for example by means of screws 30, by a blade clamping strip 31 extending parallel and in the axial direction with respect to the vertical T-leg 7. In this way, the individual perforating blade elements 8 and 9 can be individually distanced from each other at a distance "a", i.e. a tooth gap corresponding to a so-called web 34 between two cuts in the signature 19, as depicted in FIG. 3. The distance "a" can be between two and eight millimeters.

The individual perforating blade elements 8 and 9, or 36, as shown in FIG. 2, can be made of beveled steel plate or sheet of a thickness, of for example between 0.5 and 1.5 millimeters. The individual perforating blade elements 8 and 9 are each made of one piece and can be arranged symmetrically or asymmetrically with respect to the plane 11 linearly bisecting the perforating cylinder. An asymmetrical arrangement of the perforating blade elements 8, 9, as depicted in FIGS. 2 and 3, has the advantage, when perforating multi-layered signatures with, for example, up to 160 pages, that the webs 34 being created between the perforating cuts 32, 33 of both halves 39, 41 of the signature do not come to rest on top of each other following the formation of a second longitudinal fold in the plane 11 linearly bisecting the cylinder, so that "bulging" is prevented, which otherwise is caused by the respective perforation cuts 32, 33 and the webs 34 resting on top of each other.

A center perforating blade element 36, as shown in FIG. 2, is disposed between the right and left individual perforating blade elements 8 and 9 and intersects the plane 11 linearly bisecting the cylinder, and has a length "f". This center perforating blade element 36 consists of a straight segment 42, and angled segments 37 and 38 that are angled at an angle $\alpha$ with respect to the straight element 42. The angled segments 37 and 38 point in the direction of the plane 11 linearly bisecting the cylinder and in the direction of rotation C of the perforating cylinder 1.

It will be self-evident that the right or left individual perforating blade elements 8 and 9 will be placed in the perforating blade holding strip 4 with their straight segments aligned with each other over the entire length of the perforating blade strip 3. The aligned and clamped in place individual perforating blade elements 8, 36 and 9 of the perforating blade strip 3 act against an elastic, flexible counter-strip, identified generally at 67 and, as may be seen in FIG. 1, which is fastened in a cylinder trough 66 of the counter-perforating cylinder 21. The signature 19 is provided with a transverse perforation as it passes between the perforating blade strip 3, held in the perforating cylinder 1, and the counter-strip 67.

Figure 4:
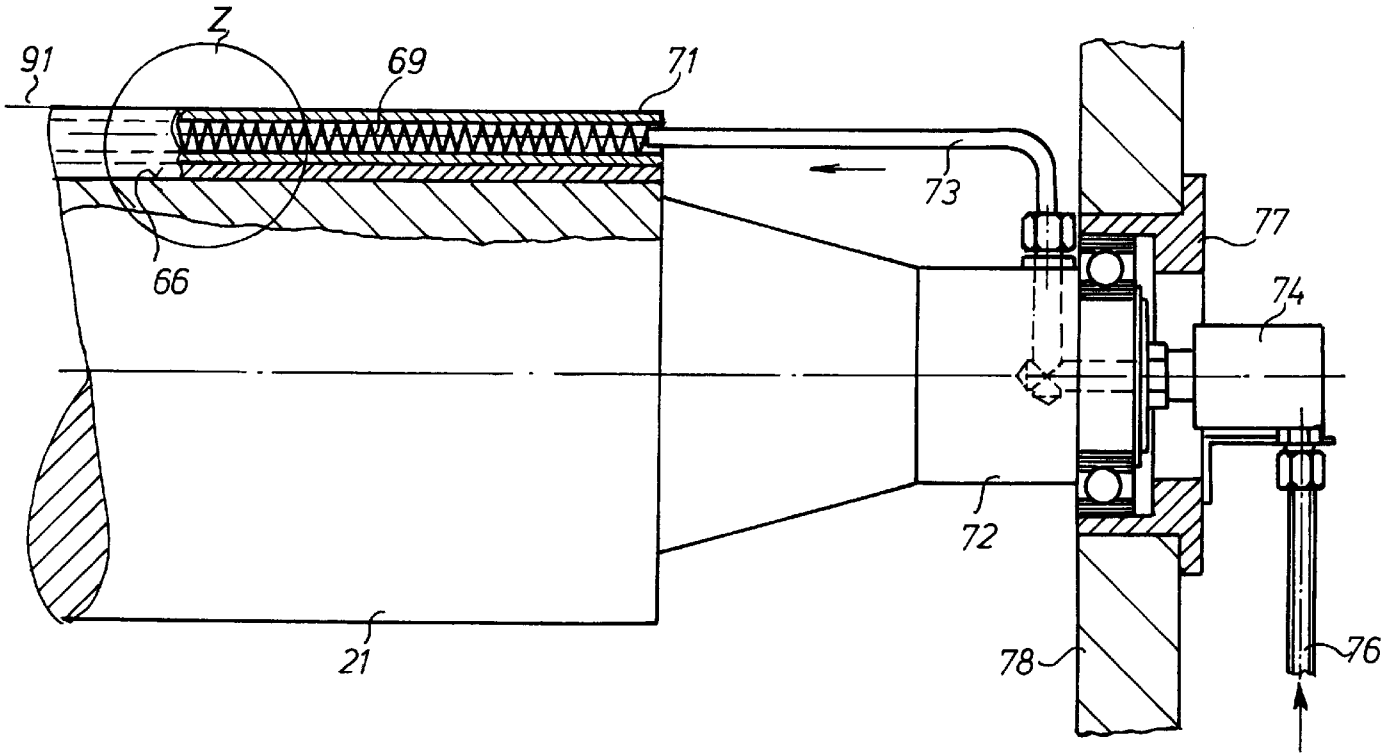
FIG. 4 is a side elevation view, partly in section, of a portion of a counter-perforating cylinder and showing the counterstrip and an associated compressed air supply arrangement.
Figure 5:
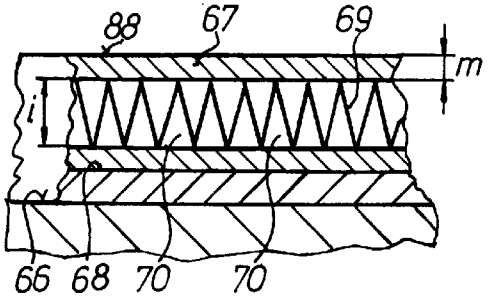
FIG. 5 is an enlarged portion of FIG. 4 as encircled at Z.

The counter-strip 67 can have a rectangular, and in particular a square cross section with a continuous bore 68 extending in the linear axial direction with respect to the counter-perforating cylinder 21, as seen in FIG. 1. A hollow support device adapted to the diameter "i" of the bore 68 and which, in the first preferred embodiment, may be a cylindrical helical spring 69, extends over the entire length of the bore 68 and rests with its outer diameter against the diameter of the bore 68 as shown in FIGS. 1, 4 and 5. This helical spring 69 has a length which is greater than the product of the number of turns and the wire diameter of the helical spring 69, so that the turns of the helical spring do not rest against each other. For example, with a wire diameter of one millimeter, there can be approximately 100 turns per 500 millimeters length of the helical spring 69 so that a gap or opening 70 of four millimeters is provided between each wire turn. Compressed air is blown into the bore 68 from at least one end 71 of the bore 68. As is depicted in FIG. 4, the end 71 of the bore 68 is connected with a compressed air line 73 that is guided through the shaft journal 72 of the counter-perforating cylinder 21. The shaft journal 72 is provided with a known rotatable inlet 74, which is connected with a compressed air source 76. The rotatable inlet 74 is fastened on the lateral frame of the press by means of a flange 77.

It is also possible to design the counter-strip 67 as a square hollow profile, in which the turns of the helical spring 69 partially rest on the inside of the hollow profile. The counter-strip 67 is made of a hard rubber-like, resilient material, for example plastic such as polyester polyol with a hardness of approximately 90 Shore A.

The operation of the signature perforating device for accomplishing the transverse perforation of signatures is as follows: in the course of operation of the folding apparatus, the signatures 19 rest against a work surface 88 of the counter-strip 67, which continues along the periphery of the counter-perforating cylinder 21 so that the signatures 19 are transversely perforated between the perforating blade strip 3 and the counter-strip 67. A distance "m" between the work surface 88 and a lowest point 89 of the cross section of the helical spring 69 is less than the penetration depth of the individual perforating blade elements 8, 36, 9 into the counter-strip 67, as seen in FIG. 1. The openings 70 of the support device, i.e. of the helical spring 69, are located opposite the work surface 88 of the counter-strip 67 at the distance "m". By means of the continued entry of the cutting edges of the individual perforating blade elements 8, 36, 9 into the counter-strip 67 at each revolution of the perforating cylinder 1, the missing piece between the penetration depth of the cutting edges and the clear diameter of the bore 68 is worked open, i.e. is made previous, so that the paper dust being generated by perforation of the signatures 19 enters the cylindrical hollow bore 68 inside the turns through the turns in the helical spring 69 located in the bore 68, from where this paper dust is blown outside by compressed air introduced from the first end 71 of the helical spring 69 or of the bore 68. It is of course also possible to aspirate the paper dust at the second end of the helical spring 69 by means of vacuum and through an analogous rotating inlet at the second shaft journal, also not shown.

Figure 6:
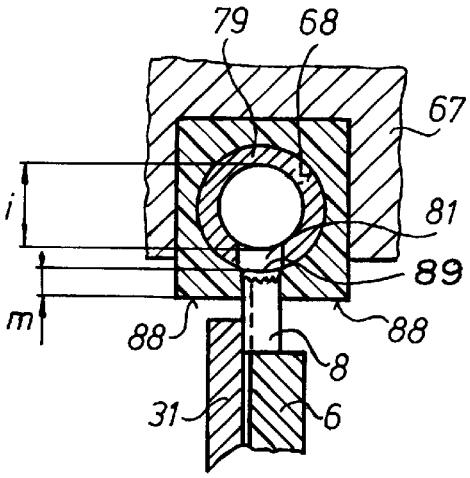
FIG. 6 is a cross-sectional view of a second preferred embodiment of a counter-strip in accordance with the present invention, together with a depiction of a perforating blade strip.

In a second preferred embodiment of the counter-strip in accordance with the present invention, the support device for the counter-strip 67 consists of a tube 79, which, as may be seen in FIG. 6, has openings oriented in the direction of the perforating blade strip 3 of the counter-perforating cylinder 21 and in the form of a continuous linear slit 81 that is extending over the entire length of the counter-strip 21. In this way, the paper dust being generated during perforation of the signatures 19 can get into the tube bore 68 by way of the notches cut into the counter-strip 67 by the perforating blade strip 3 from where it is blown out, as previously described in connection with the first preferred embodiment. In place of one linear slit 81, it is also possible to provide several linear slits extending across the entire axial length of the counter-perforating cylinder 21, with these several slits being spaced apart from each other in such a way that the linear slits respectively correspond with the individual perforating blade elements 8, 9, 36 of the perforating blade strip 3 of the counter-perforating cylinder 21.

Figure 7:
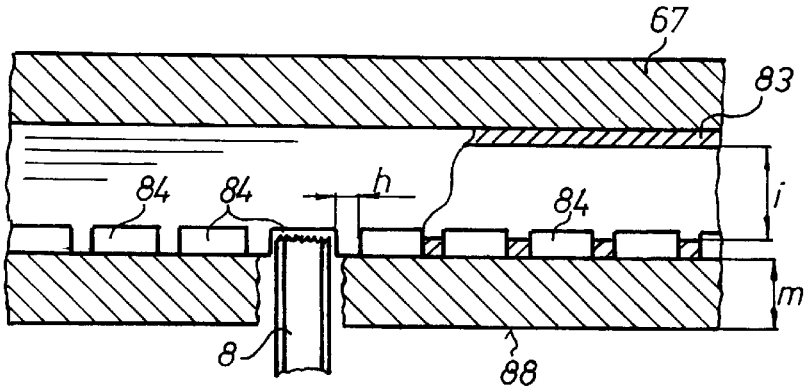
FIG. 7 is a side elevation view, partly in cross-section of a third preferred embodiment of a counter-strip with the perforating blade strip omitted and showing only one perforating blade element and its associated notch in the counter-strip.

In a third preferred embodiment, the support device of the counter-strip 67 consists of a tube 83 with several slits 84, which are spaced apart by a slit spacing distance "h" in the axial direction and which extend in the circumferential direction of the strip 67 as shown in FIG. 7. The slit spacing distance "h" can be approximately a quarter of the axial length of each one of the slits 84. The axial length of the slits 84 can also be such that the respective individual perforating blade elements 8, 9, 36 correspond in length to the slits 84, as may be seen in FIG. 7.

Figure 8:
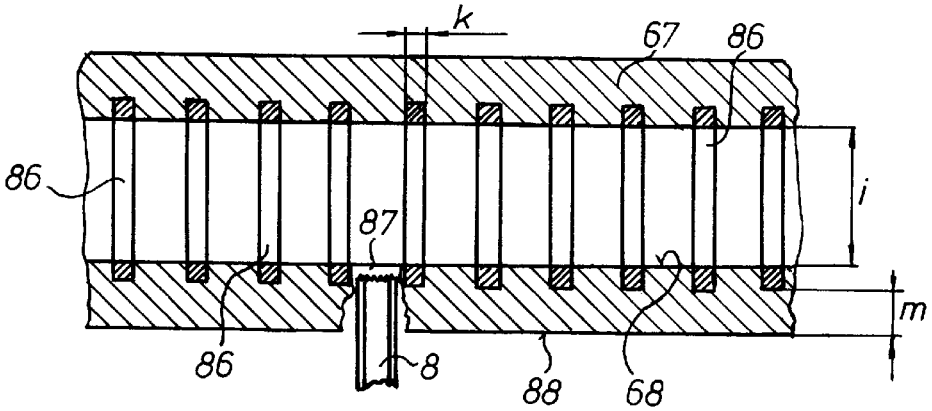
FIG. 8 is a depiction analogous to FIG. 7 and showing a fourth preferred embodiment of a counter-strip.

In a fourth preferred embodiment of the counter-strip, as shown in FIG. 8, the support device of the counter-strip 67 consists of a plurality of individual rings 86, that are spaced apart from each other in the axial direction of the counter-perforating cylinder 21, and whose interior diameter "i" corresponds to the diameter "i" of the axial bore 68 of the counter-strip 67. A thickness "k" of each of the rings 86 corresponds to approximately a quarter of the axial ring spacing distance, wherein a space between rings represents an opening 87 between the rings 86, with this opening 87 being located opposite of a work surface 88 used for the action of the individual perforating blade elements 8, 36, 9. It is also possible to connect the rings 86 with each other in the axial direction by the use of two or three bars of the same material.

The openings 81, 84, 87 mentioned in connection with the second, third and fourth preferred embodiment, can be matched to the individual perforating blade elements 8, 36, 9 in such a way that by their length and width, the individual perforating blade elements 8, 36, 9 are capable of entering the interior of the openings 81, 84, 87 at a distance which exceeds a distance "m" between the work surface 88 and the lowest point 89 of the cross section of the support device 79, 83, 86, i.e. which is greater, for example 0.5 mm.

Figure 9:
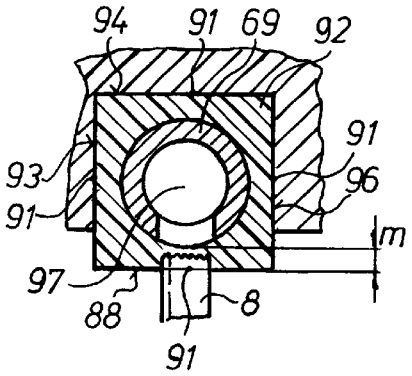
FIG. 9 is a depiction analogous to FIG. 6 and showing a fifth preferred embodiment of a counter-strip in accordance with the present invention.

A counter-strip 92 of a fifth preferred embodiment has a square cross section, as is shown in FIG. 9. The effective perforating blade line 91 of each one of the four work surfaces 88, 93, 94, 96 forming the circumference of the counter-strip 92 and extending in the axial direction of the counter-perforating cylinder 21, has respectively the same distance with respect to a linear axis 97 of the support device 69. In this way, it is possible to rotate the counter-strip 92 through 90° in the cylinder trough 66, after one of the work surfaces 88 has worn off, so that the remaining work surfaces 93, 94, 96 can also still be used. Embodiments of counter-strips with six or eight work surfaces are also possible.

While preferred embodiments of a counter-strip for a perforating device in accordance with the present invention have been set forth fully and completely hereinabove, it will be apparent to one of skill in the art that a number of changes in, for example, the overall length of the cylinders, the drive assembly for the cylinders, the type of printing press used and the like could be made without departing from the true spirit and scope of the present invention which is accordingly to be limited only by the following claims.

What is claimed is:

1. A counter-strip for use in a counter-perforating cylinder of a signature perforating device including a perforating cylinder having a perforating blade strip with individual perforating blade elements, the counter-perforating cylinder being supported for rotation about an axis of rotation, said counter-strip comprising:

a resilient strip having a rectangular cross-sectional shape and having a work surface, said work surface extending along a periphery of the counter-perforating cylinder when said counter-strip is installed in the counter-perforating cylinder;

a continuous bore in said resilient strip, said continuous bore extending in a linear direction in said resilient strip parallel to said work surface and parallel to the axis of rotation of the counter-perforating cylinder, said continuous bore having a diameter;

a hollow support device disposed in said bore and adopted in size to said diameter of said bore; and a plurality of openings in said support device, said plurality of openings being located along said bore on a side of said bore closest to said work surface.

2. The counter-strip of claim 1 wherein a distance between said work surface of said counter-strip and said bore is less than a penetration depth of the perforating blades in said counter-strip.

3. The counter-strip of claim 1 wherein said support device is a cylindrical helical spring.

4. The counter-strip of claim 3 wherein a length of said helical spring is greater than the product of the number of turns of said spring times a wire diameter of said spring.

5. The counter-strip of claim 1 further including a source of compressed air and means to supply compressed air from said source of compressed air to said continuous bore, said means to supply compressed air including a compressed air line passing through a straight journal of said counter-perforating cylinder.

6. The counter-strip of claim 1 wherein said bore is square in cross-section.

7. The counter-strip of claim 1 wherein said resilient strip is square in cross-section.

8. The counter-strip of claim 1 wherein said resilient strip has a plurality of said work surfaces with each of said work surfaces being equidistant from said bore.

9. The counter-strip in accordance with claim 1 wherein said resilient strip is a hard, material.

10. The counter-strip in accordance with claim 1 wherein said resilient strip is a polyester polyol of a hardness approximately 80 to 100 Shore A.

11. A counter-strip comprising:

a resilient strip having a rectangular cross-section with a linear axis and an external work surface;

a continuous bore in said resilient strip, said continuous bore extending parallel to said work surface in the direction of said linear axis;

a hollow support device situated in said bore; and a plurality of openings in said support device, said plurality of openings being spaced along said support device on a portion of said support device closest to said work surface.

* * * * *